US007821463B2

(12) United States Patent
Nishikido et al.

(10) Patent No.: US 7,821,463 B2
(45) Date of Patent: Oct. 26, 2010

(54) MOBILE TELEPHONE WITH BROADCAST RECEIVING ELEMENT

(75) Inventors: Tomoaki Nishikido, Ishikawa (JP); Yutaka Saito, Ishikawa (JP); Yukari Yamazaki, Toyama (JP); Yoshio Koyanagi, Kanagawa (JP); Kiyoshi Egawa, Tokyo (JP)

(73) Assignee: Panasonic Corporation, Osaka (JP)

( * ) Notice: Subject to any disclaimer, the term of this patent is extended or adjusted under 35 U.S.C. 154(b) by 632 days.

(21) Appl. No.: 11/630,144

(22) PCT Filed: Jun. 16, 2005

(86) PCT No.: PCT/JP2005/011038

§ 371 (c)(1),
(2), (4) Date: Dec. 20, 2006

(87) PCT Pub. No.: WO2005/124923

PCT Pub. Date: Dec. 29, 2005

(65) Prior Publication Data

US 2007/0247374 A1 Oct. 25, 2007

(30) Foreign Application Priority Data

Jun. 22, 2004 (JP) ..... 2004-184171

(51) Int. Cl.
*H01Q 1/24* (2006.01)
*H01Q 1/42* (2006.01)
*H01Q 1/36* (2006.01)

(52) U.S. Cl. ..... 343/702; 343/872; 343/895

(58) Field of Classification Search ..... 343/702, 343/718, 876, 895, 741, 793, 866, 872, 873
See application file for complete search history.

(56) References Cited

U.S. PATENT DOCUMENTS 4,626,862 A * 12/1986 Ma ..... 343/702
5,359,340 A * 10/1994 Yokota ..... 343/792
5,805,112 A * 9/1998 Cassel ..... 343/702

(Continued)

FOREIGN PATENT DOCUMENTS

CN 1299158 6/2001

(Continued)

OTHER PUBLICATIONS

European Search Report dated Jul. 7, 2008.

(Continued)

*Primary Examiner*—Hoang V Nguyen
*Assistant Examiner*—Robert Karacsony
(74) *Attorney, Agent, or Firm*—Dickinson Wright PLLC

(57) ABSTRACT

There is provided a mobile telephone assuring a high reception sensitivity over a wide band without deteriorating the design of the mobile telephone. In the mobile telephone, a helical antenna (4) operating as an antenna for television reception is formed by winding a conductive element along the external surface of the case several times at the upper end of the upper case (1). The helical antenna (4) is impedance-matched by a matching circuit (5) in a range of the order from 470 MHz to 700 MHz which is the television broadcast frequency. The matching circuit (5) is connected to a broadcast reception circuit (6). The broadcast reception circuit (6) operates as a reception circuit for receiving the television broadcast wave.

7 Claims, 12 Drawing Sheets

U.S. PATENT DOCUMENTS

| | | | | |
|---|---|---|---|---|
| 5,905,467 | A | 5/1999 | Narayanaswamy | |
| 6,011,519 | A * | 1/2000 | Sadler et al. | 343/742 |
| 6,154,177 | A | 11/2000 | Saito | |
| 6,459,412 | B1 | 10/2002 | Koyanagi | |
| 2002/0190906 | A1 | 12/2002 | Kim | |

FOREIGN PATENT DOCUMENTS

| | | | |
|---|---|---|---|
| GB | 2 358 991 | | 8/2001 |
| JP | 56008902 | | 1/1981 |
| JP | 61281724 | A * | 12/1986 |
| JP | 07263931 | | 10/1995 |
| JP | 09008535 | | 1/1997 |
| JP | 2000031721 | | 1/2000 |
| JP | 200077921 | | 3/2000 |
| JP | 2001223518 | | 8/2001 |
| JP | 2001/251232 | | 9/2001 |
| JP | 2001251131 | | 9/2001 |
| JP | 2002158530 | | 5/2002 |
| JP | 2005217917 | | 8/2005 |
| WO | 01/18903 | | 3/2001 |
| WO | 02/01879 | | 1/2002 |
| WO | WO 02071536 | A1 * | 9/2002 |
| WO | 03/061066 | | 7/2003 |

OTHER PUBLICATIONS

PCT International Search Report dated Sep. 27, 2005.

* cited by examiner

FIG. 6
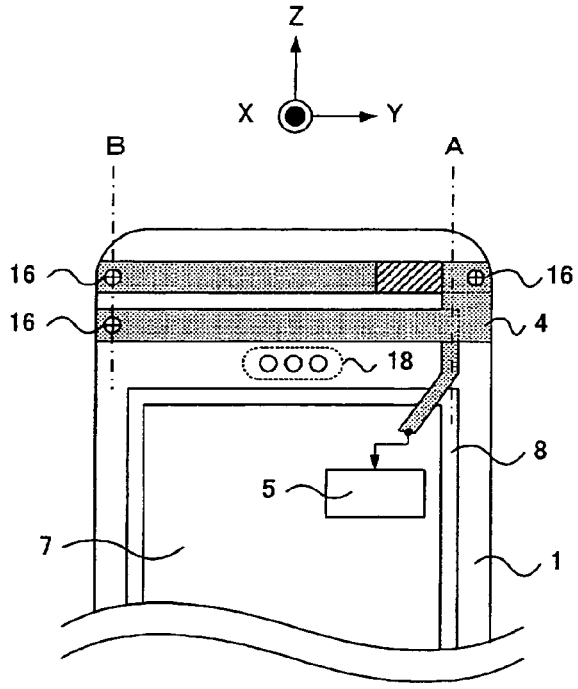
FIG.6A
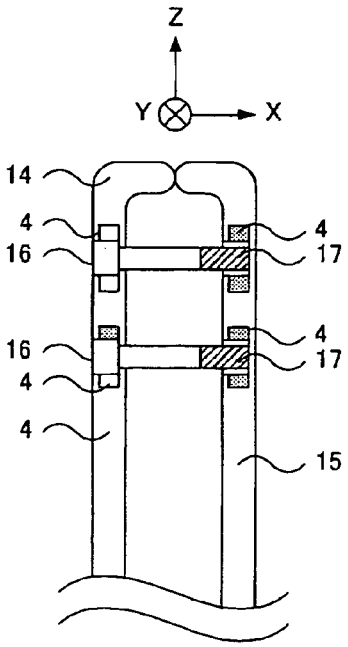
FIG.6B
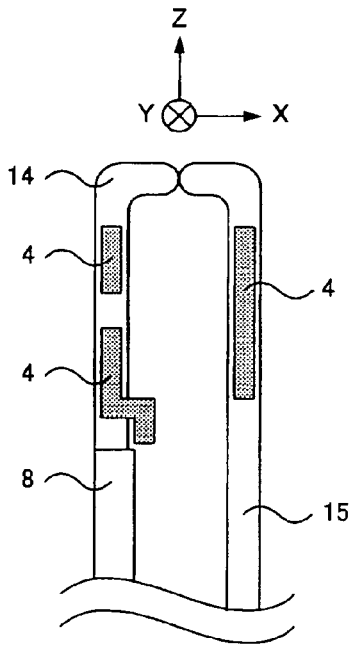
FIG.6C

FIG. 7
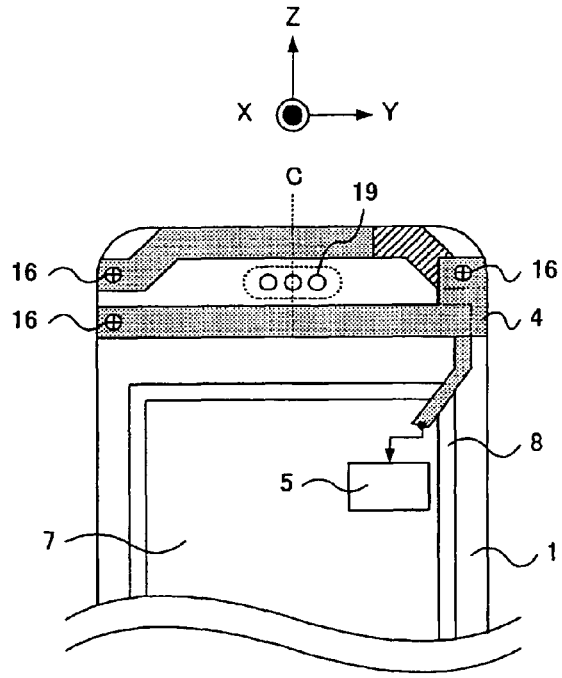
FIG.7A
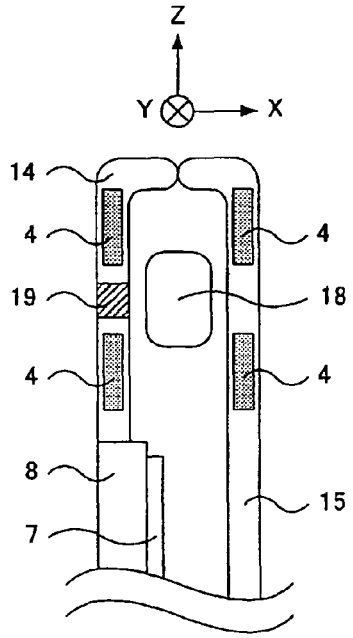
FIG.7B

MOBILE TELEPHONE WITH BROADCAST RECEIVING ELEMENT

TECHNICAL FIELD

The present invention relates to a mobile telephone with a broadcast receiving function. More particularly, the present invention relates to a mobile telephone with a broadcast receiving antenna.

BACKGROUND ART

With mobile telephones that have been widely used in recent years, functions of having a voice communication as a telephone, using an electric mail, television phone and even Internet, and, in addition, viewing and listening to ground wave television broadcast or radio broadcast have been studied for implementation.

This mobile telephone with the television broadcast receiving function requires an antenna for television reception use separately. As the prior-art mobile telephone accommodating the demand, patent document 1 discloses a technology where a rod antenna placed outside the mobile telephone forms a dipole antenna with a battery housed in the mobile terminal. Also, patent document 2 discloses a structure where a helical antenna having a diameter of 8 mm and resonating in three frequency bands is formed in three tiers, and that helical antenna having a total length of approximately 10 cm is mounted in the mobile terminal. Further, patent document 3 discloses a structure where two helical antennas are housed in a mobile telephone and are arranged orthogonal to each other.

Patent Document 1: Japanese Patent Application Laid-Open No. 2001-251131

Patent Document 2: Japanese Patent Application Laid-Open No. 2001-223518

Patent Document 3: Japanese Patent Application Laid-Open No. 2000-31721

DISCLOSURE OF INVENTION

Problems to be Solved by the Invention

However, the prior-art antenna shown in the above patent document 1 requires a rod antenna having a length of approximately 16 cm outside the mobile terminal for television reception. Even if the rod antenna is 16 cm in full-length, there is a protrusion, and there is therefore a problem that smooth removability lacks because the protrusion jams when the mobile telephone is pulled out from the place where the mobile telephone is placed including, for example, a pocket, and that flexibility in designing is damaged for the mobile telephone for which various designs are required.

Also, with the prior-art antenna shown in patent document 2, although the length of the antenna is shortened to approximately 10 cm by adopting a helical structure, there is still the same problem as the above patent document 1 because the helical antenna has a protrusion outside the mobile terminal.

In addition, with the prior-art antenna shown in patent document 3, a helical antenna is housed in the mobile telephone and therefore has a small diameter, consequently having a narrow bandwidth and being inadequate for a helical antenna for television reception use. Furthermore, the axis direction of the helical antenna is structurally close to the circuit substrate of the mobile telephone, and there is therefore a problem that radiation efficiency deteriorates.

It is therefore an object of the present invention to provide a mobile telephone with a broadcast receiver, that is able to secure excellent reception sensitivity over a wide band by having no outward protrusion, making the helical diameter larger, and making the antenna axis direction not close to the circuit substrate.

Means for Solving the Problem

A mobile telephone of the present invention adopts a configuration having: a housing that has a broadcast receiving function inside; and a circular antenna element that winds around a circumference of the housing, and, in this configuration, the circular antenna element comprises one of a helical antenna having the circumference of the housing as a helical diameter and a loop antenna element having the circumference of the housing as a loop diameter.

Advantageous Effect of the Invention

According to the present invention, by placing a circular antenna around the housing of the mobile telephone, a helical antenna is provided that has no outward protrusion and has a big helical diameter and that maintains a distance between its antenna axis direction and the circuit substrate, so that there is no longer a hooking protrusion, and smooth removability, small size, and portability are not damaged. Also, the loop opening of a helical antenna element or a loop antenna element can be made larger without damaging the design of the mobile telephone or a distance can be maintained between the axis direction of a helical antenna and the circuit substrate, so that there is an advantage of securing excellent reception sensitivity over a wide band including television broadcast.

BRIEF DESCRIPTION OF DRAWINGS

FIG. 6 is a basic configuration diagram showing a mobile telephone of a modification example of Embodiment 2 of the present invention;

FIG. 7 is a basic configuration diagram showing a mobile telephone of another modification example of Embodiment 2 of the present invention;

BEST MODE FOR CARRYING OUT THE INVENTION

Now, embodiments of the present invention will be described below in detail with reference to the accompanying drawings.

Embodiment 1

Figure 1:
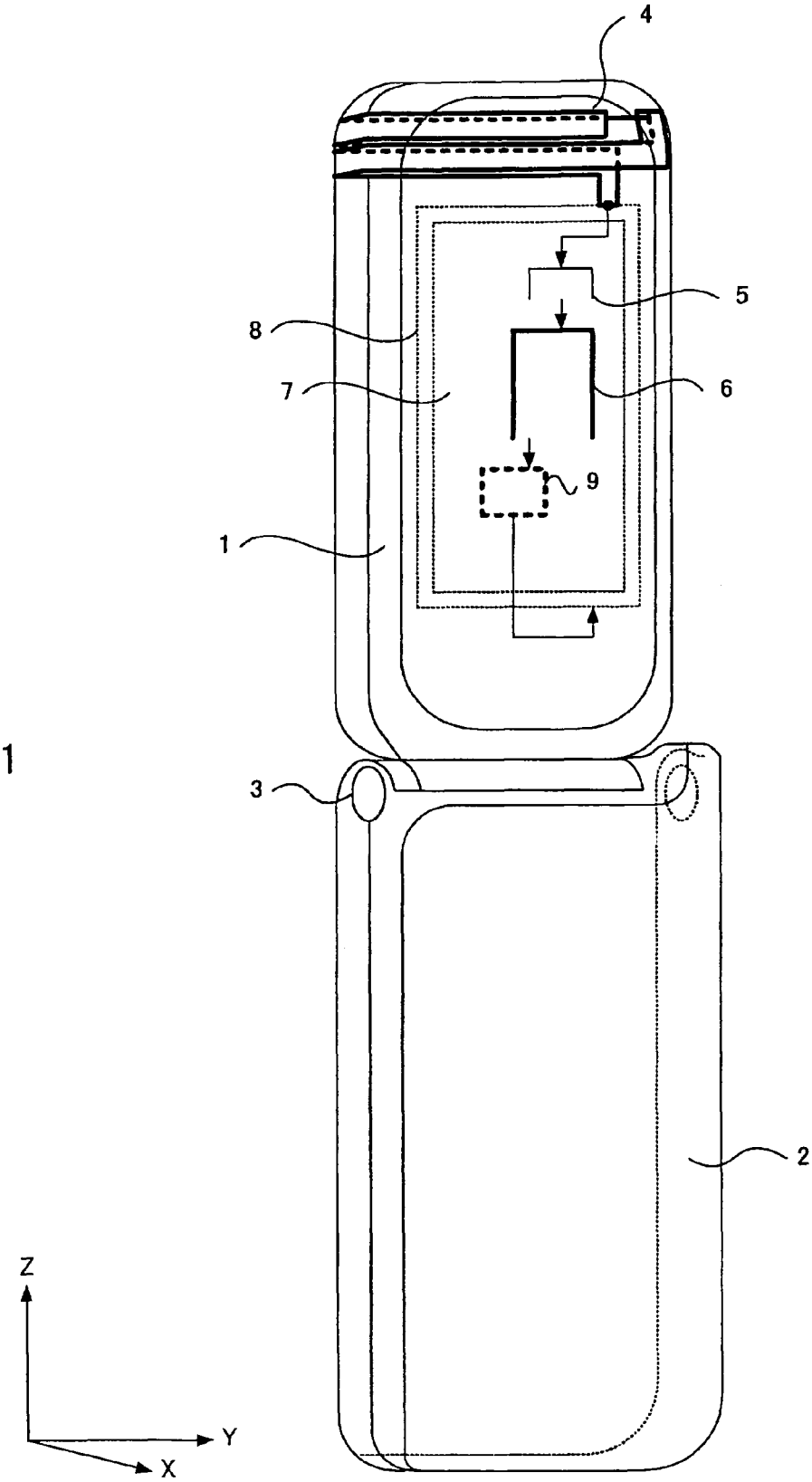
FIG. 1 is a basic configuration diagram showing a mobile telephone of Embodiment 1 of the present invention.
Figure 2:
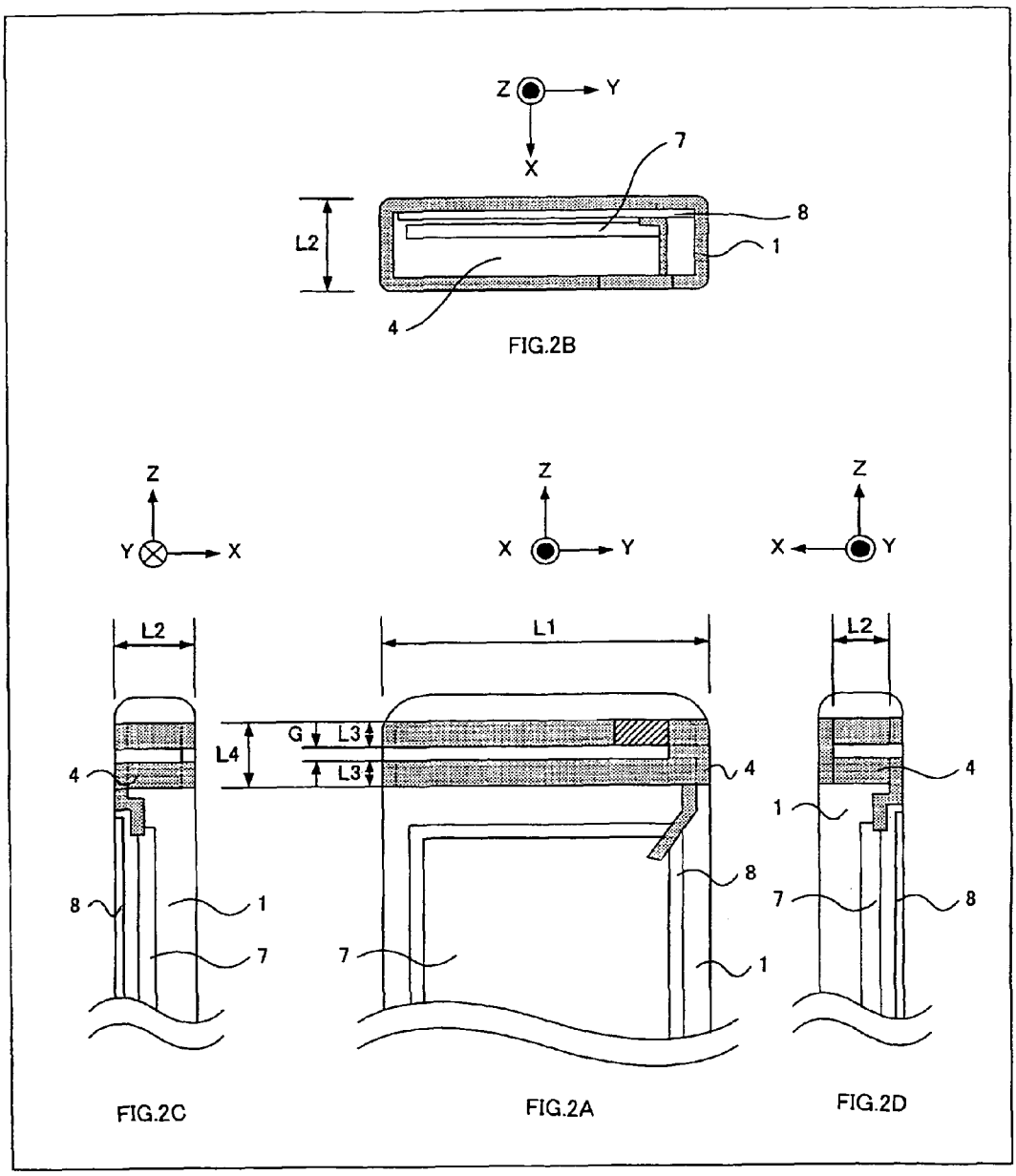
FIG. 2 is another basic configuration diagram showing a mobile telephone of Embodiment 1 of the present invention.

The mobile telephone of Embodiment 1 of the present invention will be described using FIG. 1 to FIG. 4. FIG. 1 and FIG. 2 show a basic configuration of the mobile telephone with a broadcast receiver of Embodiment 1. As shown in FIG. 1, the mobile telephone with a broadcast receiver of the present invention has a basic structure of a foldable mobile telephone where upper housing 1 and lower housing 2 are rotatably supported and are superimposed upon one another by hinge section 3.

Upper housing 1 and lower housing 2 are formed with molded articles made of an insulating resin material. A circular antenna element—that is, a helical antenna element—is provided around the front end portion of upper housing 1. Helical antenna element 4 operates as an antenna for television reception use and is formed such that a conductive element is wound several times in the front end (upper end) of upper housing 1 along the outer surface of the housing case, keeping a predetermined element gap (for example, a pitch of approximately 1 mm). Here, the conductive element is wound in the width direction of the mobile telephone mainly—that is, the Y direction shown in FIG. 1 and FIG. 2—and the axis of the helical is wound in the longitudinal direction of the mobile telephone (the Z direction shown in FIG. 1 and FIG. 2).

Helical antenna element 4 is connected to matching circuit 5, and this matching circuit 5 carries out impedance matching in the range between approximately 470 MHz and 700 MHz that are television broadcast frequencies. Further, matching circuit 5 is connected to broadcast receiving circuit 6, and this broadcast receiving circuit 6 is a receiving circuit that receives television broadcast waves that are received signals. Broadcast receiving circuit 6 is connected to image processing section 9, and this image processing section 9 carries out image processing of image signals. In addition, image processing section 9 is connected to display section 8. This display section 8 is a liquid crystal display apparatus placed on the surface of upper housing 1—that is, the surface of the -X side—with respect to the coordinate axis. After image signals outputted from broadcast receiving circuit 6 are inputted to image processing section 9, image processing section 9 controls display section 8. Further, matching circuit 5, broadcast receiving circuit 6 and image processing section 9 are arranged on circuit substrate 7.

Next, helical antenna element 4 will be described using FIG. 2. FIG. 2A, FIG. 2B, FIG. 2C and FIG. 2D show a front view, top view, left side view and right side view, respectively. Helical antenna element 4 is formed with, for example, a conductive plate—that is, a flat, metal element—where the length in the width direction, L1, including the helical diameter (though a rectangular shape is adopted in this example), is 35 mm, the height of the helices (depth), L2, is 5 mm when folded, the width of the conductive element, L3, is 4 mm, and the plate thickness of the conductive element is 1 mm. Also, element gap G that is a pitch of helical antenna element 4 is set to 1 mm. In addition, the gap between helical antenna element 4 and circuit substrate 7 is set to 3 mm (approximately a 0.005 wavelength).

By achieving a helical antenna of such a configuration, helical antenna element 4 has a total length of 150 mm and operates as a normal mode helical antenna having an element length of a quarter wavelength. Furthermore, helical antenna element 4 is made by, for example, applying an adhesive tape to the flexible, flat conductive element, and so a helical structure of two turns can be formed, without difficulty, by applying the adhesive tape to the housing surface in the front end portion of upper housing 1 of the mobile telephone.

Still further, the axis direction of helical antenna element 4 configured in this way is in parallel with a longitudinal direction of the mobile telephone—that is, the Z direction. Also, the ground pattern is generally placed all over circuit substrate 7, and so the axis direction of helical antenna element 4 is orthogonal to the ground pattern of the mobile telephone—that is, the width direction of the grounding conductor.

The operations of helical antenna element 4 of the mobile telephone with a broadcast receiver configured as above will be described using FIG. 2, FIG. 3 and FIG. 4.

Helical antenna element 4 has a diameter sufficiently smaller than the wavelength of the broadcast frequencies (for example, 60 cm), and therefore operates as a normal mode helical antenna. However, by arranging helical antenna element 4 along the housing case of the mobile telephone, it is possible to secure a maximum possible helical diameter in the mobile telephone housing. Consequently, it is possible to secure the electrical length of a quarter wavelength, without difficulty, even when the height of the helical L4 is set low—that is, when the length of helical in the axis direction is set short. By this means, it is possible to shorten the size of the helical in the Z direction, so that helical antenna element 4 can be placed in a small space in the front end portion of upper housing 1 of the mobile telephone.

For example, assume that the total length of helical antenna element 4 is approximately a 0.25 wavelength. With general, prior-art helical elements, when the helical diameter is approximately a 0.013 wavelength (a diameter when the helical is a circular shape), a height of approximately a 0.083 wavelength is required in the helical axis direction. On the other hand, with helical antenna element 4 of the present invention, the helical diameter is, for example, approximately a 0.05 wavelength (a diameter when the helical is a circular shape), so that it is possible to reduce the height of the helical axis direction down to approximately a 0.018 wavelength. In other words, compared to the general, prior-art helical elements, with helical antenna element 4 of this embodiment, the height in the axis direction can be approximately one-fourth. In other words, compared to the prior art, it is possible to make the helical diameter larger and the height in the helical axis direction lower.

In addition, by making the diameter of helical antenna element 4 larger, the effective volume of helical antenna element 4 increases, and, consequently, radiation resistance increases, so that it is possible to enable use of a wide band and improve antenna radiation efficiency.

Although the band ratio is approximately 9% in a case of the above-described general helical element, helical antenna element 4 of this embodiment achieves a band ratio of approximately 16% and enables use of a wide band to a substantial extent by making the helical diameter approximately a 0.05 wavelength that is approximately four times of the general helical element. In other words, helical antenna element 4 of the present embodiment is adequate for a television broadcast receiving antenna for which a wide bandwidth is required, and can secure high reception sensitivity over a wide band.

Figure 3:
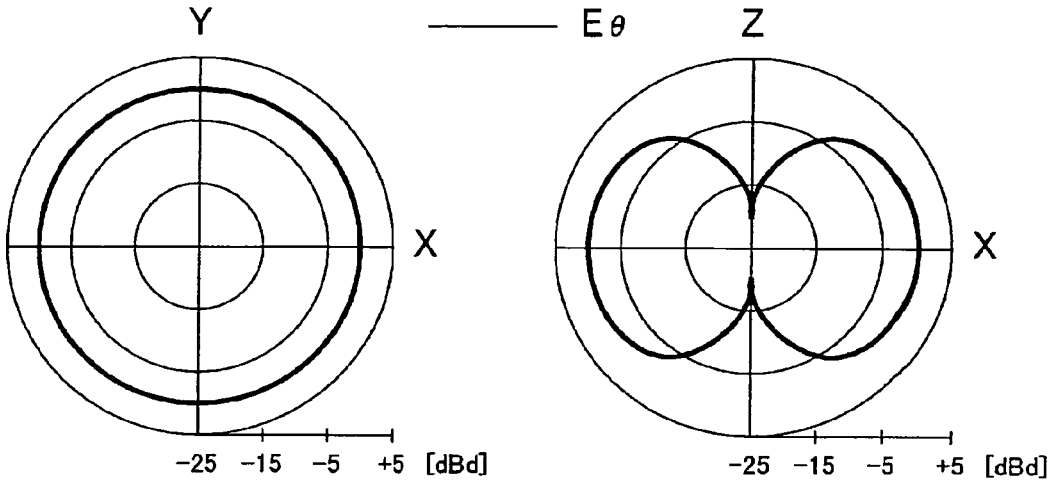
FIG. 3 is a diagram showing radiation characteristics of a mobile telephone of Embodiment 1 of the present invention.
Figure 4:
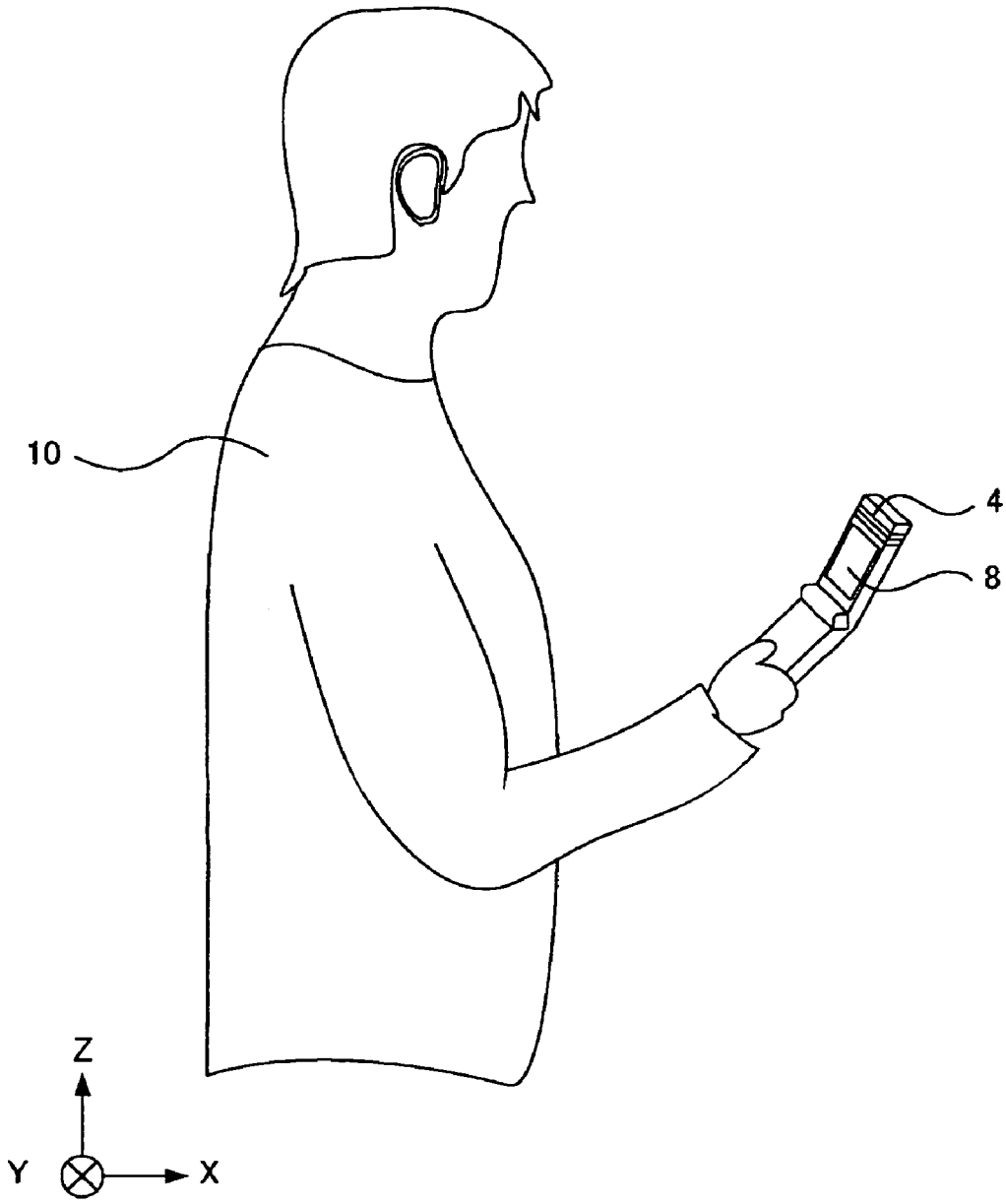
FIG. 4 is a diagram showing a state where television broadcast is viewed.

Next, the radiation pattern of helical antenna element 4 of this embodiment is shown in FIG. 3. FIG. 3 shows vertical polarized wave components (Eϕ) on the XY plane (horizontal plane) and the XZ plane (vertical plane) in the coordinate system shown in FIG. 1. Since helical antenna element 4 operates as a normal mode helical antenna, the main polarized wave direction is the axis direction of helical antenna element 4—that is, the Z direction—and the main polarized wave components are therefore vertical polarized wave components. Also, helical antenna element 4 becomes omni-directional on the XY plane and has directivity of an "8" shape on the XZ plane.

Further, when the user carries out a voice communication by holding the mobile telephone to the ear, helical antenna element 4 is close to the human head, and, therefore, the reception performance of helical antenna element 4 deteriorates. However, when user 10 views television broadcast as shown in FIG. 4, helical antenna element 4 is in a position relatively far from the body or the hand of user 10, so that helical antenna element 4 is little influenced by the hand or user 10, and high reception sensitivity can be achieved. Moreover, high reception sensitivity can be secured because user 10 operates as a reflector.

As described above, the mobile telephone with a broadcast receiver with this embodiment provides a feature of securing a maximum possible helical diameter in the mobile telephone housing and securing high reception sensitivity over a wide band without damaging the portability or the design of the mobile telephone, with a simple configuration where helical antenna element 4 for broadcast use is formed along the housing in the front end portion of upper housing 1 of the mobile telephone.

Although a case has been described with this embodiment where the antenna placed in the front end portion of upper housing 1 is a helical element, this is by no means limiting, and the same effects as the above-described helical element can be achieved by, for example, placing top load elements so as to cover the plane of the front end portion of the housing case and placing the electric field of the antenna orthogonal to the width direction of the ground conductor. In other words, the same effect can be achieved by arranging the antenna element that operates in electric field mode in the front end portion of the housing case so that the effective volume can be secured as much as possible.

Although a case has been described with this embodiment where a helical antenna is formed with a flat conductor, this is by no means limiting, and a helical configuration, where a conductive element of a thin line form is wound along the housing case, provides a slightly narrower bandwidth yet still achieves certain effect.

Also, although the above helical antenna has been described as a conductor applied on the outer surface of the housing, a configuration using a conductive material vapor-deposited on the outer surface side of the housing or a configuration using a conductive material printed on the outer surface of the housing, is also possible.

In addition, although a case has been described with this embodiment where the helical antenna is placed along the outer circumference of the housing, almost the same effect can be achieved by placing the helical antenna along the inner walls (inner surface) of the housing case.

Further, although a structure has been presented with this embodiment where helical antenna element 4 is formed along the housing case in the front end portion of upper housing 1 and placed such that the axis direction of helical antenna element 4 is orthogonal to the width direction of circuit substrate 7, with a structure where the helical antenna is formed along the housing on the side surface of upper housing 1 and placed such that the axis direction of helical antenna is orthogonal to the longitudinal direction of the circuit substrate, the main polarized components are polarized components orthogonal to the helical element of this embodiment (horizontal polarized wave), yet the effect of securing high reception sensitivity over a wide band is still achieved.

Although a structure of a foldable mobile telephone has been presented with this embodiment, the same effect can be achieved with the straight shape mobile telephone where the upper housing and the lower housing are not divided, provided that the helical element is placed appropriately.

Although the helical antenna has been presented for reception use with this embodiment, the helical antenna may also be used as an antenna for transmission use when a bi-directional communication is carried out. The same effect is achieved with an antenna for transmission and reception use.

Embodiment 2

Figure 5:
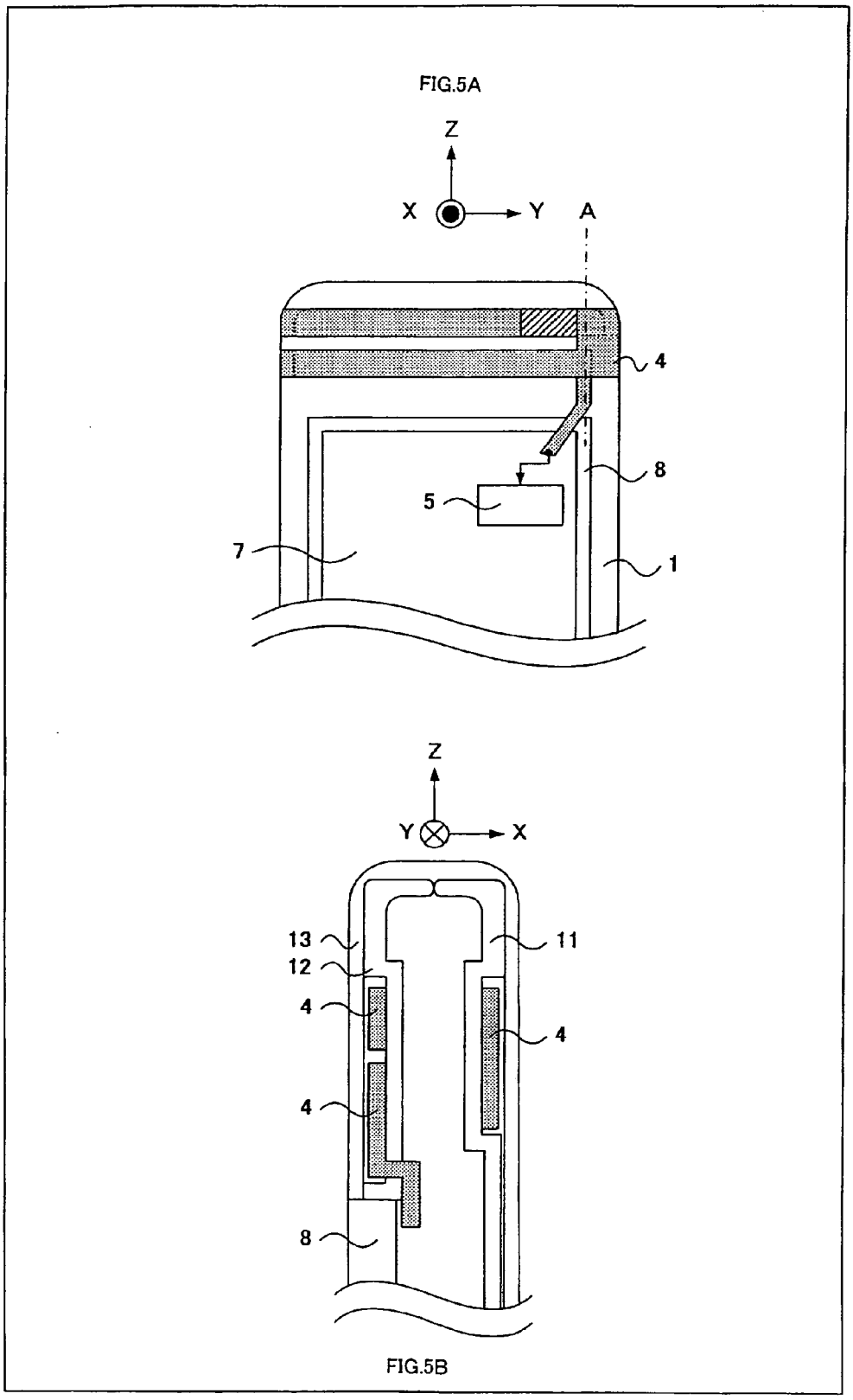
FIG. 5 is a basic configuration diagram showing a mobile telephone of Embodiment 2 of the present invention.

The mobile telephone of Embodiment 2 of the present invention will be described using FIG. 5 to FIG. 7. FIG. 5, FIG. 6, and FIG. 7 each show a configuration of the antenna of the mobile telephone with a broadcast receiver of Embodiment 2. Components assigned the same codes as in FIG. 1 and FIG. 2 show the same components and carry out the same operations.

First, the configuration of the antenna will be described. FIG. 5A shows the front view and FIG. 5B shows the cross sectional view across the dotted line A of FIG. 5A. As shown in FIG. 5B, in front case 12 made of resin on the display section 8 side, and in rear case 11 made of resin on the circuit substrate 7 side, for example, a groove of approximately 1 mm may be provided, which is equivalent to the thickness of the metal conductive plate of helical antenna element 4.

Helical antenna element 4 is made by, for example, applying an adhesive tape to a flexible, conductive plate, and a helical antenna can be configured by applying this to the resin housing along the groove that is formed in front case 12 and rear case 11 and that corresponds to the length in the width direction and the folded height. Decorative sheet 13 for protecting helical antenna 14 is applied on the surfaces of front case 12 and rear case 11. Decorative sheet 13 is made of an insulator so as not to influence the antenna operations.

The feeding section structure adopts a configuration where a slit having, for example, a width of approximately 1 mm and a length of 2 mm, is provided on the front case 12 side, and the front end portion of helical antenna element 4 placed along the outer surface of front case 12 is inserted in the slit and connected to matching circuit 5 on inner circuit substrate 7 of upper housing 1.

Helical antenna element 4 configured as above is able to secure a maximum possible helical diameter in the range of the limited housing size conditions of the mobile telephone, enables use of a wide band, and is adequate for a television broadcast receiving antenna for which a wide bandwidth is required.

Next, other examples of antenna configuration will be described. FIG. 6A shows the front view and FIG. 6B shows the cross sectional view across the dotted line B of FIG. 6A. As shown in FIG. 6B and FIG. 6C, the metal conductive plate forming helical antenna element 4 is embedded in the resin of front case 14 and rear case 15 that are made of resin and is formed integrally. To form a helical structure, as a means for connecting front case 14 where the component element of helical antenna element 4 (conductive plate) is embedded and rear case 15, for example, on the rear case 15 side, metal screw bearing 17 is provided, which connects to the conductive plate of the helical element on the rear case 15 side, and screw 16 that is connected to the helical element on the front case 14 side, is inserted from the front case 14 side. Accordingly, by connecting screw 16 and screw bearing 17, front case 14 and rear case 15 are connected, and helical antenna element 4 with two turns is formed. Also, for example, screw 16 and screw bearing 17 also serve as a fixing member that connects front case 14 and rear case 15.

As shown in FIG. 6A, the feeding structure adopts a configuration where the front end portion of helical antenna element 4 is made to protrude inside upper housing 1 and is connected to matching circuit 5 that is placed on inner circuit substrate 7 of upper housing 1.

Also, speaker 18 used when the user carries out a voice communication by holding the mobile telephone to the ear, is placed approximately 5 mm away from helical antenna element 4. Speaker 18 is preferably made of a ceramic material that is little likely to influence characteristics of helical antenna element 4.

Further, for example, when speaker 18 is placed in the front end portion of upper housing 1 as shown in the front view of FIG. 7A and the cross sectional view of FIG. 7B, the gap in helical antenna element 4 (turn pitch) is widened so that helical antenna element 4 avoids the portion of sound holes 19. By forming helical antenna element 4 in this way, it is possible to form helical antenna element 4 without sealing sound holes 19 of speaker 18 for voice communication use of the mobile telephone.

The helical antenna configured in this way is able to achieve a maximum possible helical diameter in the limited size of housing and enables use of a wide band, and, consequently, this configuration is adequate for a television broadcast receiving antenna for which a wide bandwidth is required.

As described above, the mobile telephone with a broadcast receiver according to the present invention provides a feature of securing a maximum possible helical diameter within the mobile telephone housing and securing high reception sensitivity over a wide band without damaging the portability or the design of the mobile telephone, with a simple configuration where helical antenna element 4 for broadcast reception use is formed by applying helical antenna element 4 to a concave part on the housing surface in the upper end of the housing 1 or by embedding helical antenna element 4 inside the resin housing.

Although with this embodiment a screw has been used as a means for connecting the helical element of front surface 12 and the helical element of rear case 11, this is by no means limiting, and, for example, a structure may be adopted where the conductive plate embedded in the resin placed on the side surface of front case 12, has a spring in a connecting portion with rear case 11, and that spring and the conductive plate embedded in resin placed in the side surface are connected.

Further, although the helical element is formed with a conductive plate with this embodiment, this is by no means limiting, and the same effect can be achieved by vapor-depositing metal powder on the resin housing and forming a helical antenna.

Also, the same effect can be achieved by forming a helical element by printing a conductive material on a decorative sheet and applying this decorative sheet on the resin housing.

Furthermore, the same effect can be achieved by forming a helical antenna by printing a conductive material on the resin housing.

Still furthermore, the same effect can be achieved with a structure where a helical antenna element is applied along the inner surface of the resin housing of the mobile telephone.

Embodiment 3

Figure 8:
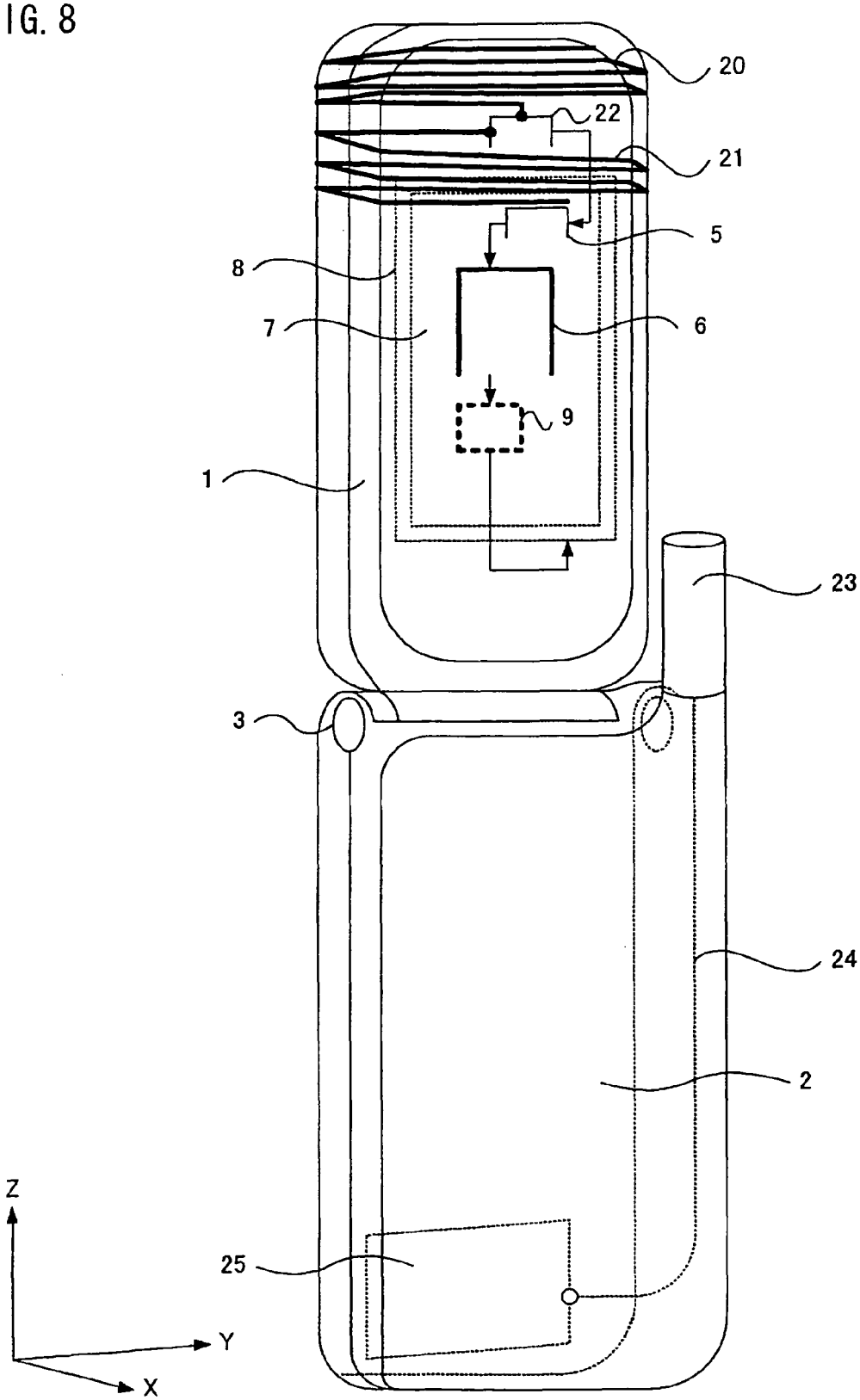
FIG. 8 is a basic configuration diagram showing a mobile telephone of Embodiment 3 of the present invention.

The mobile telephone of Embodiment 3 of the present invention will be described using FIG. 8. Components assigned the same codes as in FIG. 1 and FIG. 2 show the same components and carry out the same operations.

Two helical antenna elements 20 and 21 are formed such that a conductive element is wound several times in the front end portion of upper housing 1 along the length in the width direction of the mobile telephone—that is, along the outer surface of the housing case in the Y direction—keeping a certain element gap.

Helical antenna element 20 and helical antenna element 21 are connected to balanced-unbalanced converting circuit (balun) 22. Helical antenna element 20 and helical antenna element 21 connected to balanced-unbalanced converting circuit 22 are subjected to impedance matching by matching circuit in the range between approximately 470 MHz and 700 MHz that are television broadcast frequencies. Accordingly, helical antenna element 20 and helical antenna element 21 operate as a balanced-fed dipole antenna.

Also, communication antenna 23 placed near hinge section 3 of lower housing 2 is, for example, a radio communication antenna of the mobile telephone formed with helical antenna elements. Communication antenna 23 is fed from transmission and reception circuit 25 via feed wire 24, and transmission and reception circuit 25 transmits and receives radio communication waves of the mobile telephone.

The helical antenna operating as an antenna for television reception use configured as above will be described.

Helical antenna element 20 and helical antenna element 21 are formed with, for example, a metal conductive wire having a diameter of approximately 1 mm, and form helices around the circumference of the housing of the mobile telephone. Helical antenna element 20 and helical antenna element 21 have a diameter of approximately a 0.05 wavelength, which is sufficiently smaller than the wavelength of broadcast frequencies, and therefore operate as a normal mode helical antenna. The axial directions of helical antenna element 20 and helical antenna element 21 are in parallel with the longitudinal direction of the mobile telephone, that is, the Z direction. In addition, the ground pattern is generally placed all over circuit substrate 7, and so the axial directions of helical antenna element 20 and helical antenna element 21 are orthogonal to the ground pattern of the mobile telephone—that is, the width direction of the ground conductor.

Further, helical antenna element 20 and helical antenna element 21 operate in balanced-fed dipole mode, and the antenna current does not flow on circuit substrate 7.

Here, if the mobile telephone receives a call—that is, if communication is carried out on the mobile telephone—while television broadcast is viewed on the mobile telephone, communication antenna 23 of the mobile telephone excites neighboring circuit substrate 7, and transmission wave of the mobile telephone leaks to circuit substrate 7.

Here, for example, a case where the helical antenna for television broadcast is fed unbalanced will be considered. When the total helical length is a quarter wavelength and unbalanced-feeding is carried out, circuit substrate 7 generates an antenna current and operates as part of the television broadcast antenna. Consequently, there is a problem that transmission waves leak to television broadcast receiving circuit 6 via circuit substrate 7 and deteriorate the reception sensitivity of television broadcast.

However, when helical antenna element 20 and helical antenna element 21 are balanced-fed and operate in dipole mode, circuit substrate 7 does not operate as an antenna, so that it is possible to reduce leak of transmission waves of the mobile telephone and secure high reception sensitivity for television broadcast.

As described above, the mobile telephone with a broadcast receiver of this embodiment provides a feature of minimizing deterioration of reception sensitivity of television broadcast due to leak of the transmission wave of the mobile telephone and securing high reception sensitivity over a wide band, by forming two helical antenna elements along the housing case in the upper end of upper housing 1 of the mobile telephone and feeding these helical elements in a balanced manner.

Embodiment 4

The mobile telephone of Embodiment 4 of the present invention will be described using FIG. 9. Components assigned the same codes as in FIG. 1 and FIG. 2 show the same components and carry out the same operations.

Loop antenna 26 operates as an antenna for television reception use and is formed by winding a conductive element in the front end portion of upper housing 1 along the length in the width direction of the mobile telephone—that is, along the outer surface of the housing case in the Y direction. Loop antenna 26 is subjected to impedance matching by matching circuit in the range between approximately 470 MHz and 700 MHz that are television broadcast frequencies.

Here, loop antenna 26 is formed with, for example, a conductive plate that has a thickness of approximately 1 mm when folded and has a length in the width direction of 40 mm, an element height of 10 mm, and an element width of 10 mm. The gap between feeding sections of loop antenna 26 is set to be approximately 5 mm. This loop antenna 26 is made by, for example, applying an adhesive tape to a flexible, flat conductive element, and so a loop structure can be formed, without difficulty, by applying the adhesive tape along the housing surface in the front end of upper housing 1 of the mobile telephone.

The loop opening plane of loop antenna 26 configured in this way is orthogonal to the plane of the mobile telephone—that is, the plane of circuit substrate 7. Further, the ground pattern is generally placed all over circuit substrate 7, and it naturally follows that the loop opening plane of loop antenna 26 is orthogonal to the ground pattern—that is, the ground plane—of circuit substrate 7 of the mobile telephone.

Figure 9:
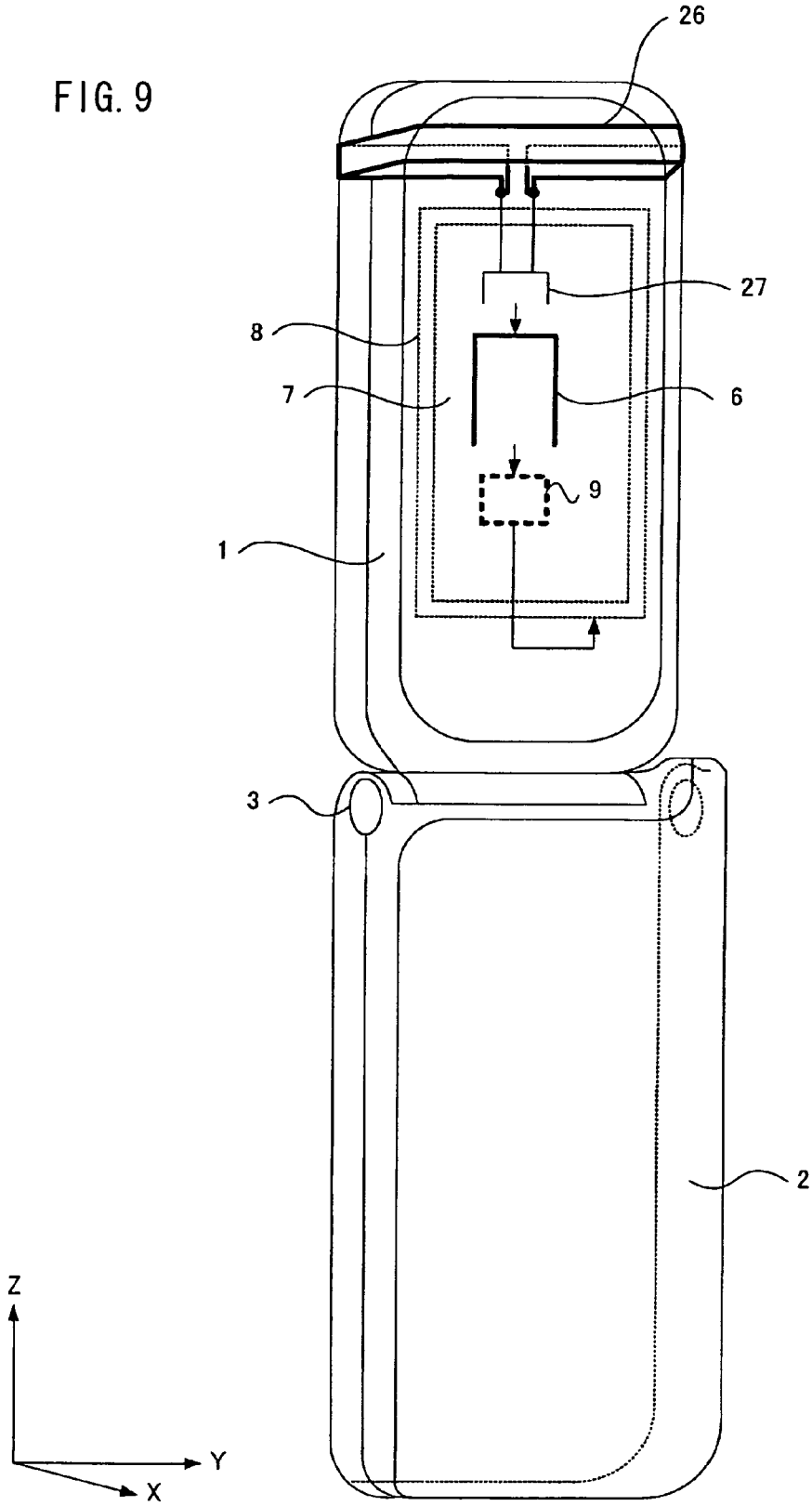
FIG. 9 is a basic configuration diagram showing a mobile telephone of Embodiment 4 of the present invention.

Also, the loop opening plane of loop antenna 26 is placed in the direction orthogonal to the longitudinal direction of the mobile telephone—that is, in parallel with the width direction of the mobile telephone (Y axis direction in FIG. 9). With this configuration, as radiation characteristics of loop antenna 26, polarized wave characteristics can be achieved in parallel with the width direction of the mobile telephone—that is, in the horizontal direction (Y axis direction)—in the arrangement in FIG. 9.

By configuring a loop antenna in this way, it is possible to secure a maximum possible loop opening plane in the range of the limited housing size conditions and enable use of a wide band, and, consequently, this configuration is adequate for a television broadcast receiving antenna for which a wide bandwidth is required.

The antenna operations of the mobile telephone with a broadcast receiver configured as above will be described. FIG. 4 shows a state where user 10 views television broadcast by placing the mobile telephone with a broadcast receiver in front of the face, holding it by the hand, and positioning display section 8 toward the face. In this state, loop antenna 26 is placed in front of the body—that is, on the +X direction side—and an antenna gain with high horizontal polarized waves can be achieved in the front direction of the body.

In addition, loop antenna 26 operating as a magnetic field mode antenna improves radiation efficiency within the range where the gap with the body is approximately a 0.2 wavelength or less because the body operates as a reflector and radiation resistance increases due to electromagnetic interaction. For this reason, the body effect of improving a gain near the body occurs.

As described above, the mobile telephone with a broadcast receiver of this embodiment provides a feature of enabling a maximum loop opening in the confined mobile telephone housing case and securing high reception sensitivity over a wide band without damaging the portability or the design of the mobile telephone, by forming a loop antenna along the housing in the upper end of upper housing 1 of the mobile telephone.

Although with this embodiment the loop antenna is placed in the upper end of upper housing 1, this is by no means limiting, and high reception sensitivity can be secured if the loop antenna is in a position where the user viewing television broadcast does not touch by hand.

Although with this embodiment a loop element of a flat shape has been presented, the same effect can be achieved, for example, with a wire element having a diameter of approximately 1 mm.

Further, a loop structure of a single turn has been presented with this embodiment, this is by no means limiting, and the same effect can be achieved with a loop antenna with a plurality of turns along the housing surface.

Although the loop antenna has been described as a conductor applied on the outer surface of the housing case, the loop antenna may be configured with a conductive material vapor-deposited on the outer surface side of the housing or may be configured with a conductive material printed on the outer surface of the housing.

Although with this embodiment the loop element has been formed with a conductive plate, this is by no means limiting, and the same effect can be achieved by vapor-depositing metal powder on the resin housing case and forming a loop element.

Also, the same effect can be achieved by forming the loop element by printing a conductive material on the decorative sheet and applying this decorative sheet on the resin housing.

Furthermore, the same effect can be achieved by forming the loop element by printing a conductive material on the resin housing case.

Still furthermore, the same effect can be achieved with a structure where the loop element is applied along the inner surface of the resin housing of the mobile telephone.

Embodiment 5

Figure 10:
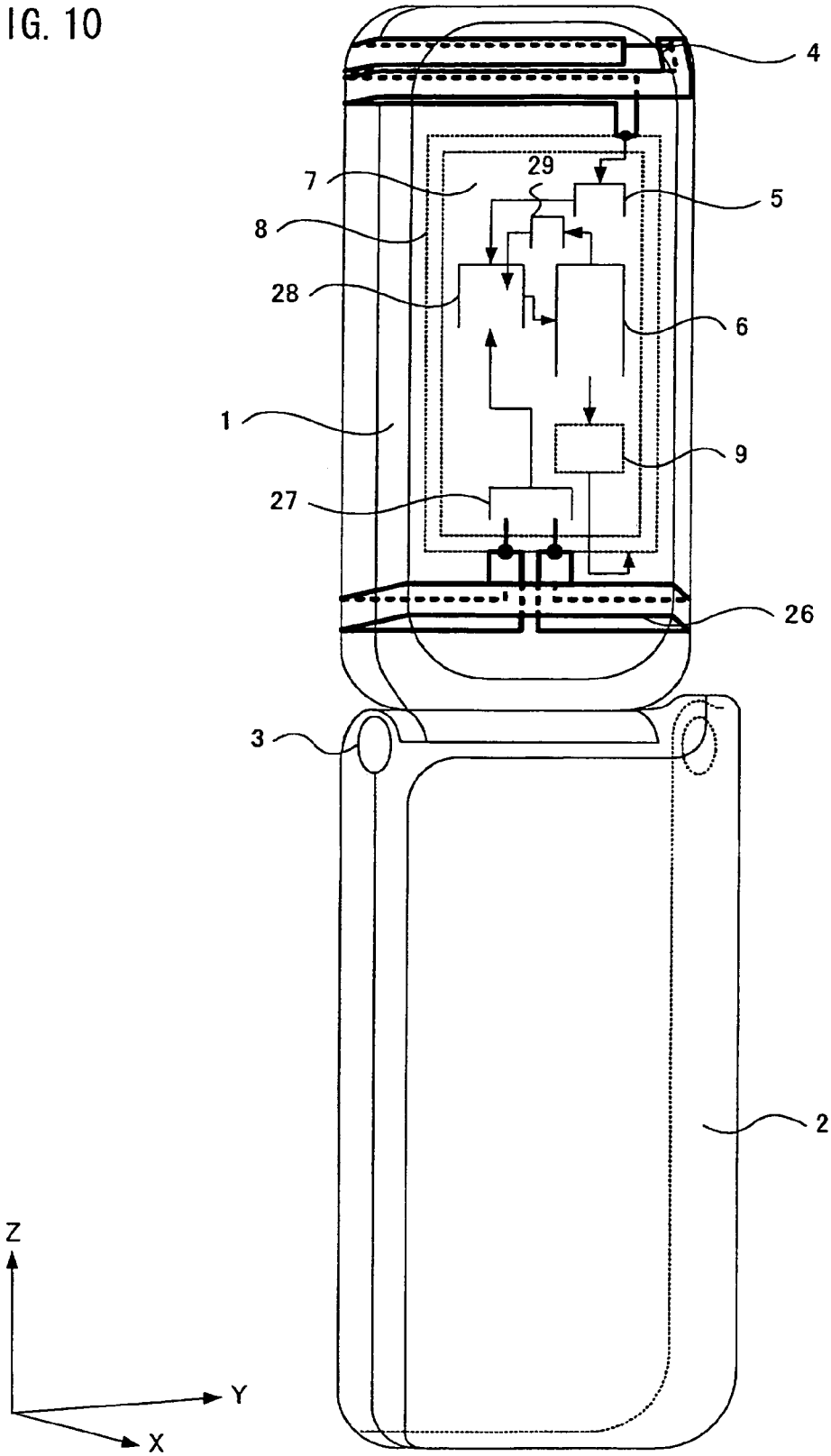
FIG. 10 is a basic configuration diagram showing a mobile telephone of Embodiment 5 of the present invention.

The mobile telephone of Embodiment 5 of the present invention will be described using FIG. 10. Components assigned the same codes as in FIG. 1 and FIG. 9 show the same components and carry out the same operations.

Loop antenna 26 is formed on rear anchor section of upper housing 1 in the same structure as in FIG. 9. Loop antenna 26 is connected to high-frequency switch 28 via matching circuit 27. Helical antenna element 4 provided in the front end portion of upper housing 1 is connected to high-frequency switch 28 via matching circuit 5.

High-frequency switch 28 is a high frequency switching circuit configured with, for example, a PIN diode and FET, and an output from high-frequency switch 28 is inputted to broadcast receiving circuit 6.

Antenna switching control section 29 detects received signal strength at broadcast receiving section 6 and operates so as to switch high-frequency switch 28 in accordance with that received signal level.

For example, by adopting a configuration where antenna switching control section 29 operates to select one antenna between helical antenna element 4 and loop antenna 26 which has a higher received signal level, it is possible to select an antenna element by which high reception sensitivity can be achieved.

The antenna operations of the mobile telephone with a broadcast receiver configured as above will be described.

Helical antenna element 4 operates as a normal mode helical antenna, and, consequently, the main polarized wave direction is the axis direction of helical antenna element 4—that is, the Z direction. The main polarized wave components are therefore vertical polarized wave components, and helical antenna element 4 operates as an electric field mode antenna.

The loop opening plane of loop antenna 26 is placed in the direction orthogonal to the longitudinal direction of the mobile telephone (Y axis direction in FIG. 9). With this configuration, as radiation characteristics of loop antenna 26, polarized wave characteristics in parallel with the width direction of the mobile telephone—that is, in the horizontal direction (Y axis direction)—in the arrangement in FIG. 10 can be achieved, and loop antenna 26 consequently operates as an electric field mode antenna. Further, when user 10 views television broadcast as shown in FIG. 4, helical antenna element 4 and loop antenna 26 operate as an antenna having different polarized wave characteristics—that is, vertical polarized waves and horizontal polarized waves, respectively—and, by selecting between these two antennas by high frequency switch 28, it is possible to achieve polarized wave diversity effect.

In general, in the multipath environment such as an urban area where a large number of reflecting objects exist, the diversity effect of approximately 5 dB to 10 dB can be achieved by the above-noted polarized wave diversity operations. Accordingly, it is possible to increase the reception sensitivity for television broadcast. Also, when the foldable mobile telephone is closed, helical antenna element 4 is close to lower housing 2. When the circuit substrate placed inside lower housing 2 is close to helical antenna element 4, radiation resistance of helical antenna element 4 is reduced, and, therefore, radiation efficiency of helical antenna element 4 deteriorates. On the other hand, in a case of loop antenna 26, the loop opening plane is orthogonal to the ground pattern—that is, the ground plane—of circuit substrate 7 of the mobile telephone, so that deterioration of radiation efficiency is small even when the mobile telephone is closed.

As described above, the mobile telephone with a broadcast receiver according to the present invention provides a feature of improving the reception sensitivity for television broadcast and receiving television broadcast even when the mobile telephone is closed, by polarized wave diversity effect, by forming a helical antenna and loop antenna having different main polarized wave components along the case of upper housing 1 of the mobile telephone.

Although with this embodiment a loop antenna has been used as an electric field mode antenna, this is by no means limiting, and any antenna that operates in electric field mode, such as a slot element, may be adopted.

Also, although the polarized wave diversity effect of the magnetic field mode antenna and the electric field mode antenna has been described, this is by no means limiting, and the polarized wave diversity effect of the electric field mode antenna can be achieved when the axis directions of the two helical antennas placed along the housing circumference of the mobile telephone are orthogonal to each other.

Also, a method of switching the magnetic mode antenna and the electric mode antenna is not limited to the method of switching in accordance with the reception level, and a configuration may be adopted where the user performs the switching by operating the mobile telephone, or a configuration may be adopted where a means for detecting the opening and closing of the housing is provided and switch to the loop antenna side is forcefully made when the housing is closed.

Further, although antenna switching diversity has been described, this is by no means limiting, and high reception sensitivity can be achieved with a configuration where two systems of a broadcast receiving circuit and demodulating circuit are provided and the demodulating circuit combines the received signals of a plurality of antennas by a predetermined weighting factor.

Embodiment 6

The mobile telephone of Embodiment 6 of the present invention will be described using FIG. 11 and FIG. 12. Components assigned the same codes as in FIG. 1 and FIG. 10 show the same components and carry out the same operations.

Earphone 31 is inserted in the ear of the user for listening to the sound of television, and is connected to earphone connector 36 via earphone cable 36. Sound signal 32 outputted from broadcast receiving circuit 6 is inputted to earphone connector 36.

Earphone cable 30 transmits sound signal 32 and operates as an external antenna that receives television broadcast waves. Television broadcast waves received at earphone cable 30 are inputted to high-frequency switch 28 via earphone connector 36 and matching circuit 33.

Antenna switching control section 29 detects reception signal strength at broadcast receiving circuit 6, and operates to switch high-frequency switch 28 in accordance with that received signal level. For example, by adopting a configuration where antenna switching control section 29 operates to select one antenna between helical antenna element 4 and earphone cable 30 which has a higher received signal level, it is possible to select an element having higher antenna characteristics.

Figure 11:
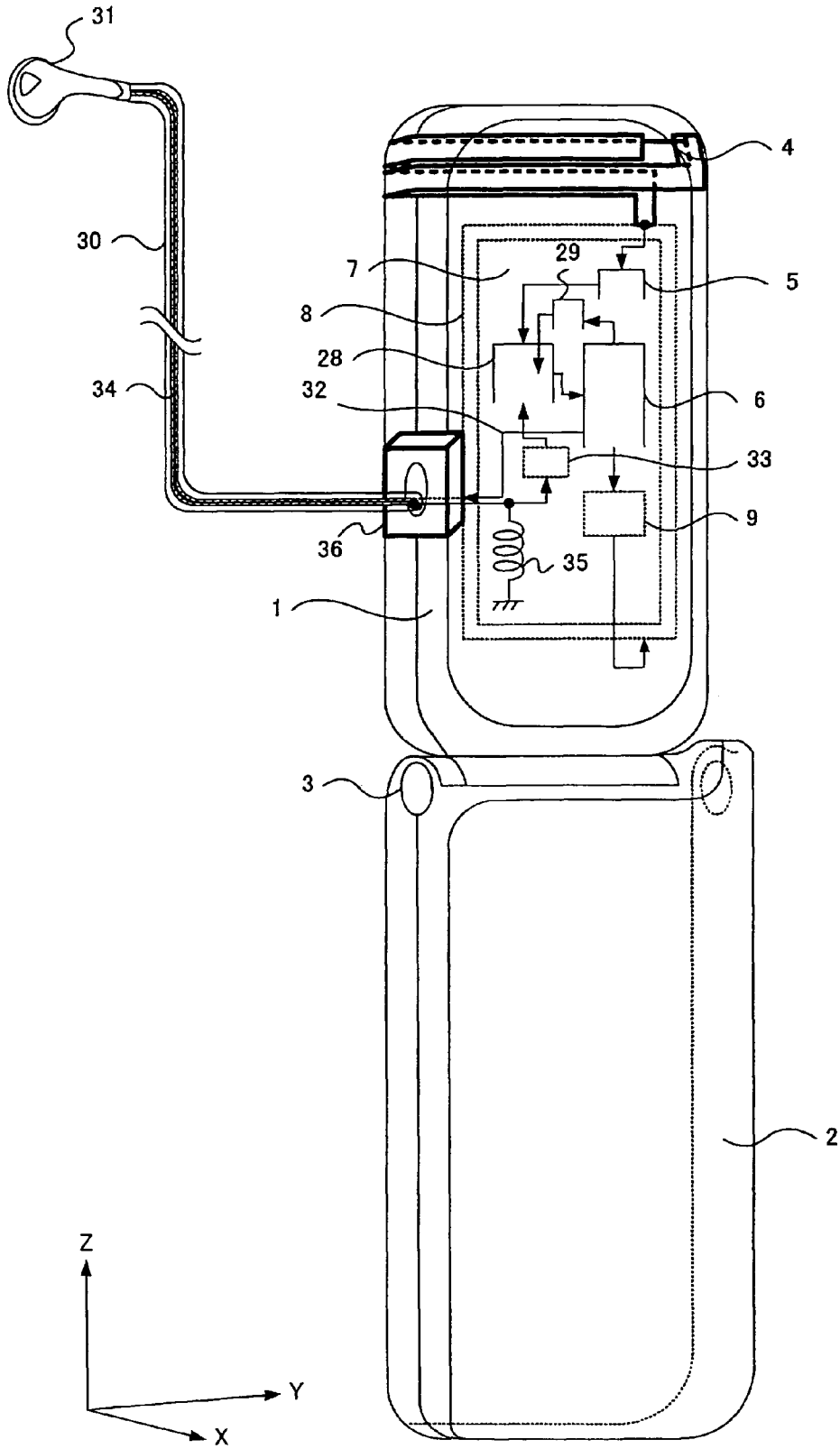
FIG. 11 is a basic configuration diagram showing a mobile telephone of Embodiment 6 of the present invention.

In FIG. 11, extra-ground conductor 34 is formed with, for example, a conductive wire in a mesh form that covers and shields sound signal wire 35 in earphone cable 30. Extra-ground conductor 34 and sound signal wire 32 are connected up to earphone 31 in earphone cable 30.

Next, the antenna operations of earphone cable 30 will be described using FIG. 11. In FIG. 11, the length of earphone cable 30 is set to be, for example, approximately 50 cm to 100 cm. This length is approximately from a 0.8 wavelength to a 2.3 wavelength in the television broadcast receiving band.

Earphone cable 30 is inserted in earphone connector 36 and is thereby connected to the circuit in the mobile telephone. Extra-ground conductor 34 is connected to the ground in the mobile telephone—that is, the ground potential—via coil 35, and extra-ground conductor 34 thereby shielding sound signal wire 32 in the low frequency band.

Extra-ground conductor 34 is connected to high-frequency switch 28 via matching circuit 33. Here, the value of coil 35 is set so that impedance is sufficiently high in the television broadcast frequency band. With this configuration, extra-ground conductor 34 operates as an external antenna that receives television broadcast waves.

Figure 12:
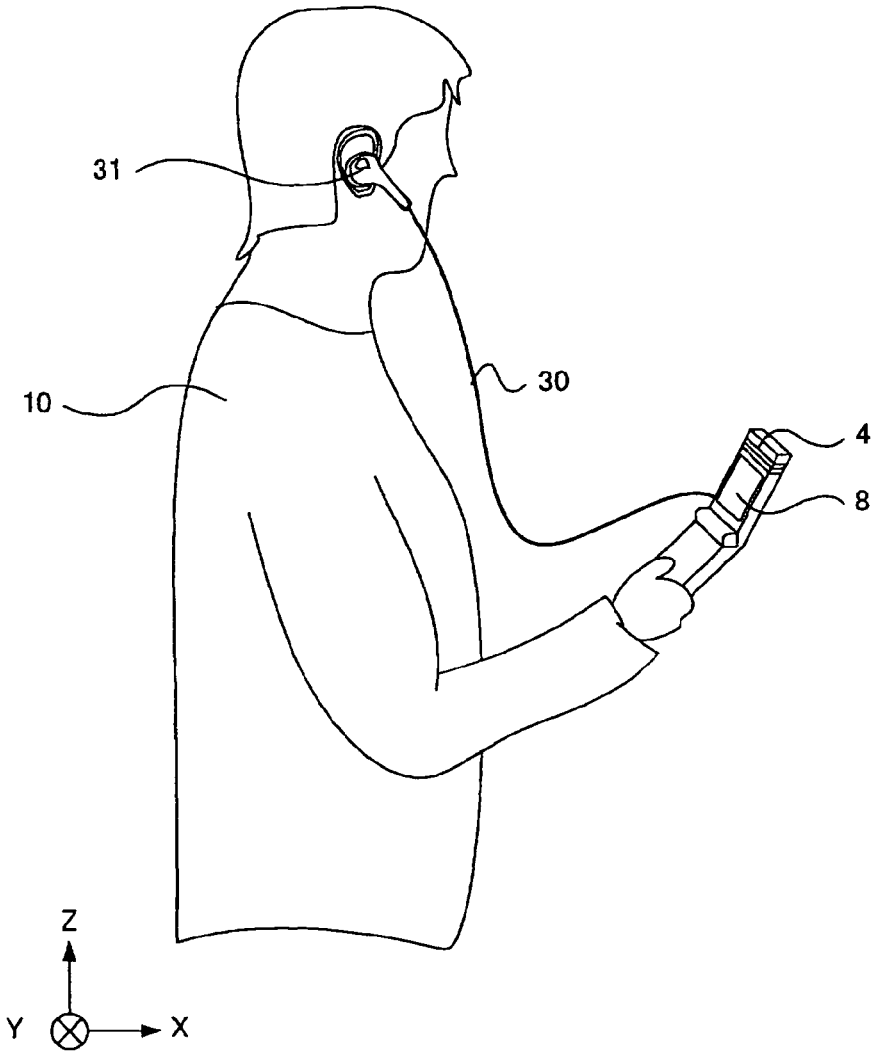
FIG. 12 is a diagram showing a state where television broadcast is viewed.

FIG. 12 shows a state where user 10 views television broadcast by placing the mobile telephone with a broadcast receiver in front of the face, holding it by the hand, and positioning display section 8 toward the face. Earphone 31 is inserted in the ear of user 10, and earphone cable 30 hangs down to the mobile telephone with a broadcast receiver.

Earphone cable 30 hangs down in the vertical direction—that is, in the Z axis direction—and so extra-ground conductor 34 in earphone cable 30 operates as an antenna with vertical polarized wave characteristics.

Further, since helical antenna element 4 operates as a normal mode helical antenna, the main polarized wave direction is the axis direction of helical antenna element 4—that is, the Z direction. The main polarized wave components are therefore vertical polarized wave components, and helical antenna element 4 operates as an electric field mode antenna.

In this way, when television broadcast is viewed, helical antenna element 4 and earphone cable 30 operate as vertical polarized wave antennas keeping a distance of approximately a 0.05 wavelength, and by selecting between these two antennas by high frequency switch 28, it is possible to achieve space diversity effect.

Also, when the foldable mobile telephone is closed, helical antenna element 4 is close to lower housing 2. When the circuit substrate placed inside lower housing 2 is close to helical antenna element 4, radiation resistance of helical antenna element 4 is reduced, and, therefore, radiation efficiency of helical antenna element 4 deteriorates. On the other hand, in a case of the antenna using earphone cable 30, the antenna exists outside, and deterioration of radiation efficiency is therefore small even when the mobile telephone is closed.

As described above, the mobile telephone with a broadcast receiver provides a feature of improving the reception sensitivity of television broadcast and receiving television broadcast even when the mobile telephone is closed, by space diversity effect between the helical antenna mounted on along the housing case of the mobile telephone and the antenna using the earphone cable.

Although with this embodiment diversity of the helical antenna and the antenna using the earphone cable has been described, this is by no means limiting, and polarized wave diversity effect can be expected when a loop antenna and earphone antenna are used.

This application is based on Japanese Patent Application No. 2004-184171, filed on Jun. 22, 2004, the entire content of which is expressly incorporated by reference herein.

INDUSTRIAL APPLICABILITY

The mobile telephone with a broadcast receiver according to the present invention is able to secure high reception sensitivity over a wide band without damaging the portability or the design of the mobile telephone, and, therefore, this configuration is useful for providing a high-performance mobile telephone with a broadcast receiver.

The invention claimed is:

1. A mobile telephone comprising:

a housing that houses a broadcast receiver; and a helical antenna element that is configured for receiving broadcast signals and winds around a circumference of the housing, wherein:

the housing has an upper housing part having a display section for viewing a broadcast received by the broadcast receiver, and a lower housing part that is supported by the upper housing part so as to be rotatable with respect to the upper housing part, and the helical antenna element is provided at an upper end part of the upper housing part, with the circumference of the upper housing as a helical diameter and a helical axis direction of the helical antenna element matching a longitudinal direction of the housing.

2. The mobile telephone according to claim 1, wherein the helical antenna element comprises a conductive material that is applied, vapor-deposited, or printed on an outer surface of the upper housing part.

3. The mobile telephone according to claim 1, wherein the helical antenna element comprises a conductive material embedded inside the upper housing part.

4. The mobile telephone according to claim 1, wherein the helical antenna element comprises a conductive material that is applied, vapor-deposited, or printed on an inner surface of the upper housing part.

5. The mobile telephone according to claim 1, wherein two helical antenna elements are configured to receive signals in a balanced manner and to operate in dipole mode.

6. The mobile telephone according to claim 1, further comprising:

a loop antenna element configured for receiving broadcast signals, the loop antenna element being provided at a lower end part of the upper housing part and having the circumference of the upper housing as a loop diameter; and an antenna switching section configured for selecting one of the helical antenna element and the loop antenna element and for inputting a signal received in the selected antenna element to a broadcast receiving circuit.

7. The mobile telephone according to claim 1, further comprising:

an antenna element that is configured using an earphone cable; and an antenna switching section configured to select one of the helical antenna element and the earphone cable antenna element and to input a signal received in the selected antenna element to a broadcast receiving circuit.

* * * * *